US009263061B2

(12) United States Patent
Hines et al.

(10) Patent No.: US 9,263,061 B2
(45) Date of Patent: Feb. 16, 2016

(54) DETECTION OF CHOPPED SPEECH

(71) Applicant: Google Inc., Mountain View, CA (US)

(72) Inventors: Andrew J. Hines, Dublin (IE); Jan Skoglund, Mountain View, CA (US); Naomi Harte, Dublin (IE); Anil Kokaram, Mountain View, CA (US)

(73) Assignee: GOOGLE INC., Mountain View, CA (US)

( * ) Notice: Subject to any disclaimer, the term of this patent is extended or adjusted under 35 U.S.C. 154(b) by 311 days.

(21) Appl. No.: 13/899,381

(22) Filed: May 21, 2013

(65) Prior Publication Data

US 2015/0199979 A1 Jul. 16, 2015

(51) Int. Cl.
*G10L 25/78* (2013.01)

(52) U.S. Cl.
CPC ..... *G10L 25/78* (2013.01)

(58) Field of Classification Search
CPC ..... G10L 25/21; G10L 25/60; G10L 25/69; G10L 19/005; G10L 19/167
USPC ..... 704/210
See application file for complete search history.

(56) References Cited

U.S. PATENT DOCUMENTS

| | | | | |
|---|---|---|---|---|
| 4,821,325 | A * | 4/1989 | Martin et al. | 704/253 |
| 6,275,345 | B1 * | 8/2001 | Ottesen et al. | 360/25 |
| 6,741,569 | B1 * | 5/2004 | Clark | 370/252 |
| 7,072,828 | B2 * | 7/2006 | Petty | 704/210 |
| 7,657,388 | B2 * | 2/2010 | Reynolds et al. | 702/69 |
| 7,929,520 | B2 * | 4/2011 | Li | 370/352 |
| 8,831,936 | B2 * | 9/2014 | Toman et al. | 704/228 |
| 2004/0167775 | A1 * | 8/2004 | Sorin | 704/208 |
| 2005/0015253 | A1 * | 1/2005 | Rambo et al. | 704/246 |
| 2006/0088093 | A1 * | 4/2006 | Lakaniemi et al. | 375/240.01 |
| 2006/0265211 | A1 * | 11/2006 | Canniff et al. | 704/210 |
| 2008/0027716 | A1 * | 1/2008 | Rajendran et al. | 704/210 |
| 2009/0099843 | A1 * | 4/2009 | Barriac et al. | 704/200.1 |
| 2009/0154726 | A1 * | 6/2009 | Taenzer | 381/94.1 |

OTHER PUBLICATIONS

Mengyao Zhu; Jia Zheng; Xiaoqing Yu; Wanggen Wan, "Audio Quality Assessment Improvement via Circular and Flexible Overlap," Multimedia (ISM), 2011 IEEE International Symposium on , vol., No., pp. 47,52, Dec. 5-7, 2011.*

(Continued)

*Primary Examiner* — Peter K Huntsinger
*Assistant Examiner* — Walter Yehl
(74) *Attorney, Agent, or Firm* — Birch, Stewart, Kolasch & Birch, LLP

(57) ABSTRACT

Methods and systems are provided for detecting chop in an audio signal. A time-frequency representation, such as a spectrogram, is created for an audio signal and used to calculate a gradient of mean power per frame of the audio signal. Positive and negative gradients are defined for the signal based on the gradient of mean power, and a maximum overlap offset between the positive and negative gradients is determined by calculating a value that maximizes the cross-correlation of the positive and negative gradients. The negative gradient values may be combined (e.g., summed) with the overlap offset, and the combined values then compared with a threshold to estimate the amount of chop present in the audio signal. The chop detection model provided is low-complexity and is applicable to narrowband, wideband, and superwideband speech.

17 Claims, 6 Drawing Sheets

(56) References Cited

OTHER PUBLICATIONS

Dini, P.; Font-Bach, O.; Mangues-Bafalluy, J., "Experimental analysis of VoIP call quality support in IEEE 802.11 DCF," Communication Systems, Networks and Digital Signal Processing, 2008. CNSDSP 2008. 6th International Symposium on , vol., No., pp. 443-447, Jul. 25-25, 2008.*

Abareghi, M.; Homayounpour, M.M.; Dehghan, M.; Davoodi, A., "Improved ITU-P.563 Non-Intrusive Speech Quality Assessment Method for Covering VOIP Conditions," Advanced Communication Technology, 2008. ICACT 2008. 10th International Conference on , vol. 1, No., pp. 354-357, Feb. 17-20, 2008.*

Nocito, C.D.; Scordilis, M.S., "Monitoring jitter and packet loss in VoIP networks using speech quality features," Consumer Communications and Networking Conference (CCNC), 2011 IEEE , vol., No., pp. 685-686, Jan. 9-12, 2011.*

Rix, A.W.; Beerends, J.G.; Hollier, M.P.; Hekstra, A.P., "Perceptual evaluation of speech quality (PESQ)—a new method for speech quality assessment of telephone networks and codecs," Acoustics, Speech, and Signal Processing, 2001. Proceedings. (ICASSP '01). 2001 IEEE International Conference on , vol. 2, No., pp. 749,752 vol. 2, 2001.*

Lijing Ding; Goubran, R.A., "Speech quality prediction in VoIP using the extended E-model," Global Telecommunications Conference, 2003. GLOBECOM '03. IEEE , vol. 7, No., pp. 3974,3978 vol. 7, Dec. 1-5, 2003.*

* cited by examiner

DETECTION OF CHOPPED SPEECH

BACKGROUND

Choppy speech describes degradation where there are gaps in the speech signal. The degradation manifests itself as syllables appearing to be dropped or delayed. The speech is often described as a stuttering or a staccato. It is sometimes referred to as time-clipped speech or broken voice. It is generally periodic in nature, although the rate of chop and duration of chops can vary depending on the cause and on network parameters.

Choppy speech occurs for a variety of reasons such as CPU overload, low bandwidth, congestion, codec mismatch, or latency. When frames are missed or packets are dropped, segments of the speech are lost. This can occur at any location within speech, but is more noticeable and has a higher impact on perceived quality when it occurs in the middle of a vowel phoneme than during a silence period. Choppy speech is indeed a problematic issue in Internet audio delivery, such as VoIP systems.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to systems and methods for audio signal processing. More specifically, aspects of the present disclosure relate to detecting chop in an audio signal.

While some existing non-reference quality metrics predict a general score due to almost any type of degradation, the model described herein relates to a pure detection of a certain type of distortion, audio chopping, and in accordance with at least one embodiment, the model is insensitive to other types of distortion. The model is also low in computational complexity and can be applied to narrowband, wideband, and superwideband speech.

One embodiment of the present disclosure relates to a method for detecting chop in an audio signal, the method comprising: creating a time-frequency representation for an audio signal; calculating a gradient of mean power per frame of the audio signal based on the time-frequency representation; determining an overlap offset between positive values of the gradient and negative values of the gradient; combining the positive values of the gradient or the negative values of the gradient with the overlap offset; and estimating an amount of chop in the audio signal based on a comparison of the combined values to a threshold.

In another embodiment, the method for detecting chop in an audio signal further comprises defining positive and negative gradient signals based on the calculated gradient of mean power, wherein the positive gradient signal includes the positive values of the gradient and the negative gradient signal includes the negative values of the gradient.

In yet another embodiment of the method for detecting chop, the operation of determining the overlap offset between the positive values of the gradient and the negative values of the gradient includes calculating a value that maximizes the cross-correlation of the positive gradient signal and the negative gradient signal.

Another embodiment of the present disclosure relates to a system for detecting chop in an audio signal, the system comprising one or more processors and a computer-readable medium coupled to the one or more processors having instructions stored thereon that, when executed by the one or more processors, cause said one or more processors to perform operations comprising: creating a time-frequency representation for an audio signal; calculating a gradient of mean power per frame of the audio signal based on the time-frequency representation; determining an overlap offset between positive values of the gradient and negative values of the gradient; combining the positive values of the gradient or the negative values of the gradient with the overlap offset; and estimating an amount of chop in the audio signal based on a comparison of the combined values to a threshold.

Still another embodiment of the present disclosure relates to one or more non-transitory computer readable media storing computer-executable instructions that, when executed by one or more processors, cause the one or more processors to perform operations comprising: creating a time-frequency representation for an audio signal; calculating a gradient of mean power per frame of the audio signal based on the time-frequency representation; determining an overlap offset between positive values of the gradient and negative values of the gradient; combining the positive values of the gradient or the negative values of the gradient with the overlap offset; and estimating an amount of chop in the audio signal based on a comparison of the combined values to a threshold.

In one or more other embodiments, the methods and systems described herein may optionally include one or more of the following additional features: the amount of chop in the audio signal is estimated based on a log ratio of the sum of the combined values above the threshold to the sum of the combined values below the threshold; the time-frequency representation is a short-term Fourier transform (STFT) spectrogram representation created with critical frequency bands between 150 and 3,400 Hz, between 150 and 8,000 Hz, or over 8,000 Hz; the time-frequency representation is a short-term Fourier transform (STFT) spectrogram representation created with logarithmically spaced frequency bands between 150 and 3,400 Hz, between 150 and 8,000 Hz, or over 8,000 Hz; the creation of the time-frequency representation for the audio signal includes using a 256-sample, 50% overlap Hanning window for an audio signal with 16 kHz sampling rate and a 128-sample, 50% overlap Hanning window for an audio signal with 8 kHz sampling rate.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
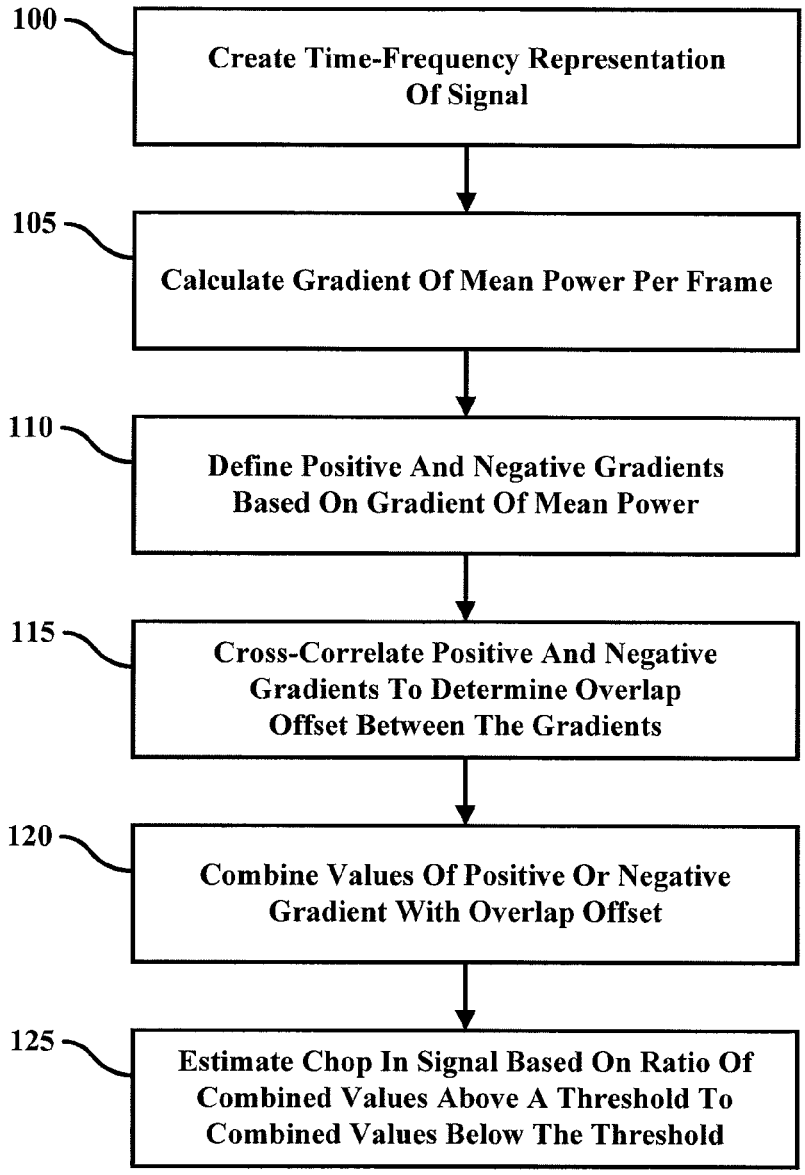
FIG. 1 is a collection of graphical representations illustrating an example of chop occurring in an audio signal according to one or more embodiments described herein.

The headings provided herein are for convenience only and do not necessarily affect the scope or meaning of the claimed embodiments.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples and embodiments. One skilled in the relevant art will understand, however, that the examples and embodiments described herein may be practiced without many of these details. Likewise, one skilled in the relevant art will also understand that the examples and embodiments described herein can include many other obvious features not described in detail herein. Additionally, some well-known structures or functions may not be shown or described in detail below, so as to avoid unnecessarily obscuring the relevant description.

Embodiments of the present disclosure relate to methods and systems for detecting chop (e.g., choppy speech) in an audio signal. As will be described in greater detail below, the chop detection model provided herein uses a time-frequency representation (e.g., a short-term Fourier Transform (STFT) spectrogram) of a signal to measure changes in the gradient of the mean frame power.

In accordance with at least one embodiment, the time-frequency representation or STFT spectrogram may be created using critical bands between 150 and 8,000 Hz for wideband speech and between 150 and 3,400 Hz for narrowband speech. A 256-sample, 50% overlap Hanning window may be used for signals with 16 kHz sampling rate while a 128-sample, 50% overlap Hanning window may be used for signals with 8 kHz sampling rate to keep frame resolution temporally consistent. A gradient of the mean power per frame, g[i], may be calculated as $$g = \nabla P = \frac{\partial P}{\partial t}. \tag{1}$$

A positive gradient signal, $g_p[i]$, and a negative gradient signal, $g_n[i]$, can be defined as $$g_p[i] = \begin{cases} g[i] & \text{if } g[i] > 0 \\ 0 & \text{if } g[i] \le 0 \end{cases}$$

-continued $$g_n[i] = \begin{cases} -g[n] & \text{if } g[i] < 0 \\ 0 & \text{if } g[i] \ge 0 \end{cases}$$

The maximum overlap offset j is calculated as the value that maximizes the cross-correlation of $g_p[i]$ and $g_n[i]$ as $$R_{g_n g_p}[j] = \sum_i g_n[i] g_p[i-j]. \tag{2}$$

The $g_n[i]$ and the offset $g_p[i-j]$ may be summed as $$g_c[i] = g_n[i] + g_p[i-j], \tag{3}$$

and a log ratio of the sum of values above a threshold $c_T$, denoted $c_+$, to the sum below the threshold, denoted $c_-$, is taken to estimate the amount of chop in the signal:

$$c_+[i] = \begin{cases} g_c[i] & \text{if } g_c[i] > c_T \\ 0 & \text{if } g_c[i] \le c_T \end{cases} \tag{4}$$

$$c_-[i] = \begin{cases} g_c[i] & \text{if } g_c[i] < c_T \\ 0 & \text{if } g_c[i] \ge c_T \end{cases}$$

$$\text{chop} = \log_{10} \frac{\sum_i c_+[i]}{\sum_i c_-[i]}.$$

FIG. 1 illustrates an example process for detecting chop in an audio signal according to one or more embodiments described herein.

At block 100, a time-frequency representation may be created for an audio signal. In accordance with at least one embodiment, the time-frequency representation may be a short-term Fourier transform (STFT) spectrogram representation, which may be created with a range of frequency bands applicable to narrowband (up to 3,400 Hz), wideband (up to 8,000 Hz), or superwideband (over 8,000 Hz) audio. Depending on the implementation, the time-frequency representation may be created with critical frequency bands or logarithmically scaled/spaced frequency bands within the applicable range.

It should be noted that numerous other time-frequency representations, including variations in window size, window overlap, and/or window type of frequency bands utilized may also be used in accordance with one or more embodiments described herein, in addition to or instead of the example time-frequency representations described above.

At block 105, the time-frequency representation created at block 100 may be used to calculate a gradient of mean power per frame of the audio signal. Equation (1), described above, provides an example of how the gradient of mean power per frame, g[i], may be calculated in accordance with at least one embodiment.

At block 110, positive and negative gradient signals (e.g., $g_p[i]$ and $g_n[i]$) or signal parts may be defined using the gradient mean power per frame calculated at block 105.

At block 115, a maximum overlap offset may be determined for the positive and negative gradients. Equation (2), described above, provides an example of how the maximum overlap offset (e.g., j) may be calculated in accordance with at least one embodiment. For example, the maximum overlap offset may be calculated as the value that maximizes the cross-correlation of $g_p[i]$ and $g_n[i]$.

At block 120, the values of one of the gradients may be combined with the overlap offset determined at block 115. Equation (3), described above, provides an example of how one of the gradients (e.g., $g_n[i]$) and the offset $g_p[i-j]$ may be combined (e.g., summed)).

The process may then move to block 125, where an amount of chop in the audio signal may be estimated based on a comparison of the combined values obtained at block 120 to a threshold (e.g., $c_T$). In accordance with at least one embodiment, the amount of chop present in the audio signal may be estimated by taking a log ratio of the sum of the combined values (from block 120) above a threshold (e.g., $c_+$) to the sum of the combined values below the threshold (e.g., $c_-$), as described above with respect to equation (4).

EXAMPLE EMBODIMENT

In an example embodiment of the chop detection model described herein, a test dataset was created using thirty (30) samples from a speech corpus. Ten sentences from three speakers, each of approximately three seconds in duration were used as source stimuli. A cursory validation with a small number of real clipped and chopped speech samples was also undertaken using wideband recordings of choppy speech caused by a codec mismatch and clipped speech recorded using a laptop microphone.

The test data was evaluated using four other objective speech quality models: Virtual Speech Quality Objective Listener (ViSQOL, which is a full-reference model), PESQ (Perceptual Evaluation of Speech Quality), POLQA (Perceptual Objective Listening Quality Assessment, successor model to PESQ), and P.563 (ITU standard no-reference model).

Two tests were carried out using chopped speech. Using the thirty source sentences, twenty degraded versions of each sentence were created using two chop frame periods of 10 milliseconds (ms) and 15 ms. This simulated packet loss from 3% to 32% of the signals. Because the test did not simulate packet loss concealment, the samples for the chopped frames were set to zero.

The chop detection model of the present disclosure was cross-validated with the clipped stimuli to establish a minimum detection threshold boundary and to ensure that the model was detecting the expected distortion/degradation type.

Figure 2:
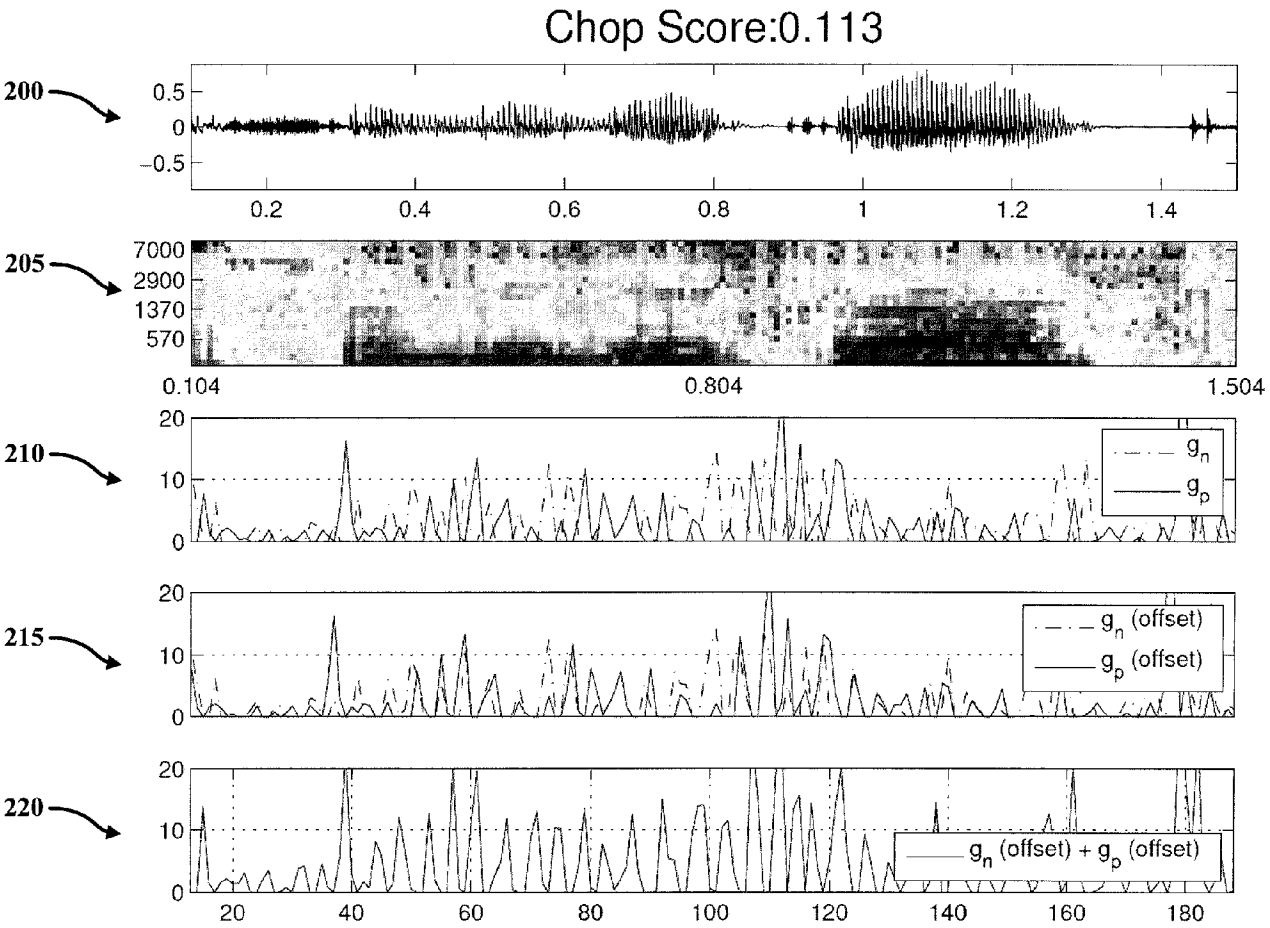
FIG. 2 is a graphical representation illustrating example results of a method for detecting chop in an audio signal according to one or more embodiments described herein.

A limited test was carried out with real choppy data. In the present example, wideband speech with a severe amount of chop was tested. The chop in the test was caused by a codec mismatch between the sender and receiver systems. A segment of the test signal is illustrated in FIG. 2. The topmost plot 200 shows the signal followed by the signal spectrogram 205. The chop is visible as periodic white bands in the higher frequencies of the spectrogram 205. The gradients, $g_p$ and $g_n$ are shown in plot 210 with the offset versions that have been aligned shown in plot 215. The bottom plot 220 shows the sum of the offset gradients. Plot 220 has sharp peaks corresponding to the chop and may be used to calculate the chop score, which will be further described below.

Figure 3:
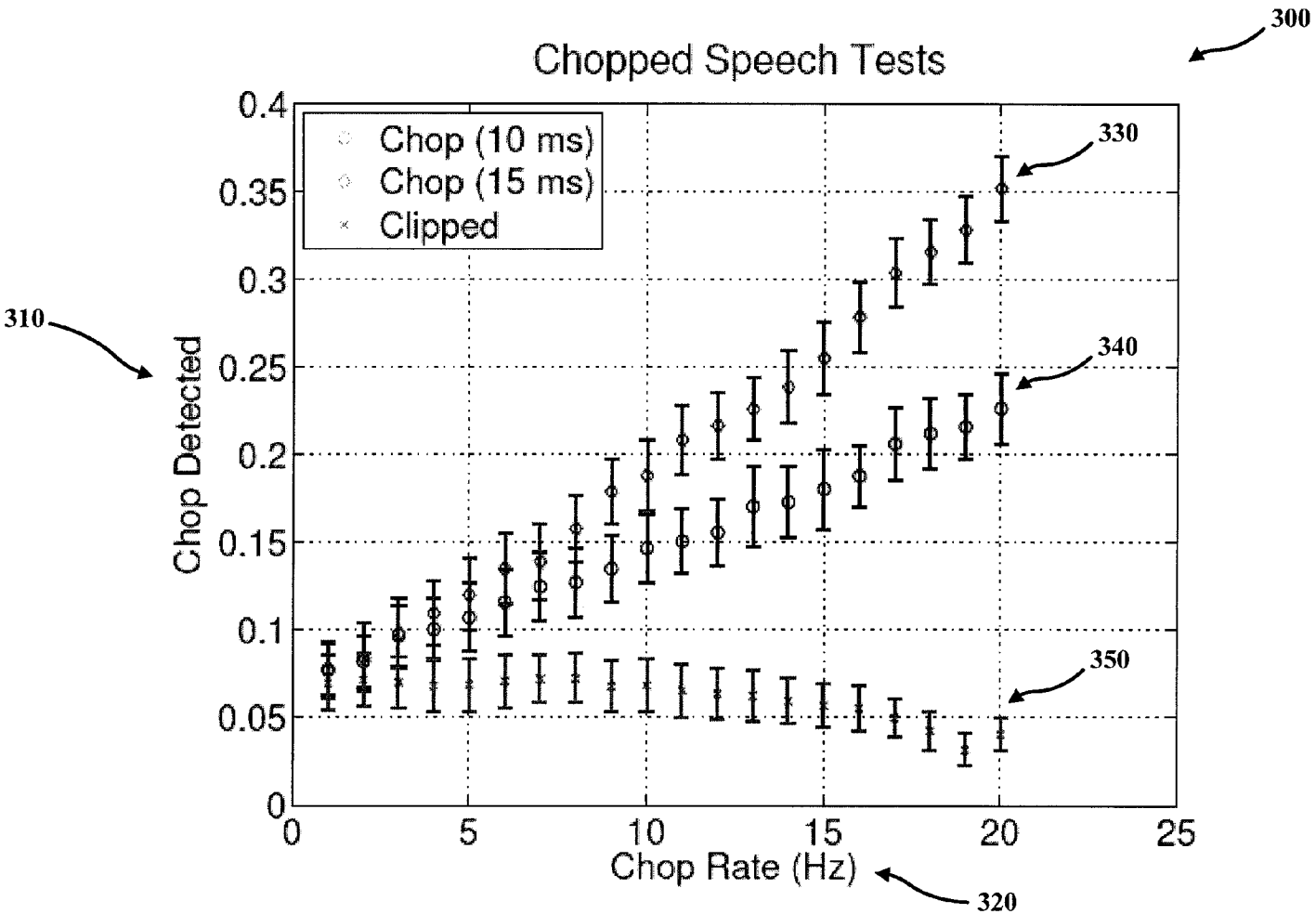
FIG. 3 is a collection of graphical representations illustrating comparisons of the example results shown in FIG. 2 with other objective speech quality metrics.

FIG. 3 illustrates example results obtained using the chopped speech detection model according to one or more embodiments described herein. The plot 300 includes example results for the 10 ms chop frame period 340 and the 15 ms chop frame period 330, with the chop rate increasing from left to right along the x-axis 320 and the y-axis 310 showing the model output score. The plot 300 also depicts example results for amplitude clipped speech 350 to illustrate the method's insensitivity to other types of distortion/degradation. Twenty levels of progressive amplitude clipping are represented on the horizontal axis 320. The clipping results 350 highlight that there is a lower bound for the chop detection threshold.

Figure 4:
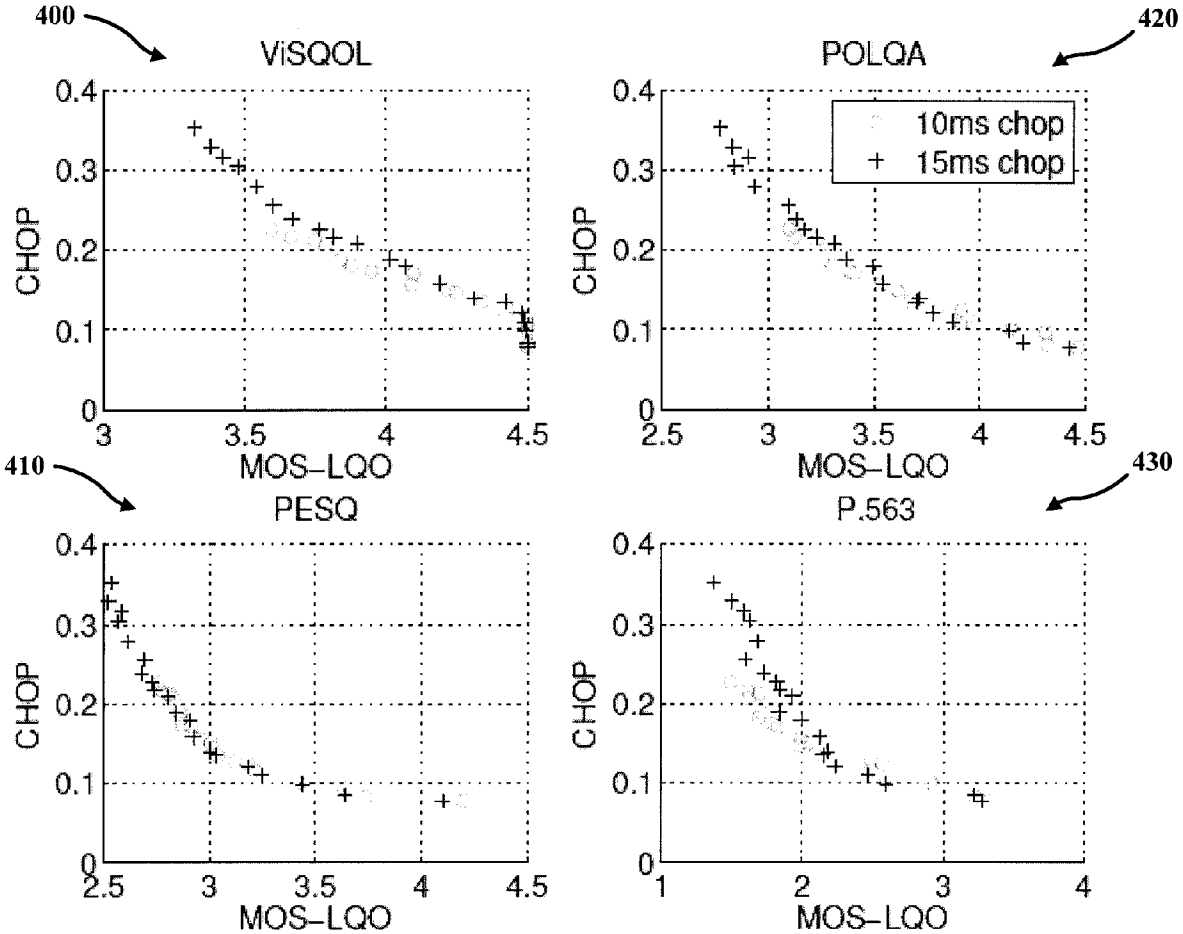
FIG. 4 is a collection of graphical representations illustrating an example of an audio signal with and without chop included according to one or more embodiments described herein.

FIG. 4 illustrates comparisons between the example output of the chopped speech detection model of the present disclosure and four other objective speech quality metrics. The other objective speech quality metrics used in the comparisons include ViSQOL 400, PESQ 410, POLQA 420, and P.563 430. Each of the plots (400, 410, 420, and 430) shows the example results of the chopped speech detection model (illustrated in FIG. 3), for both the 10 ms chop frame period and the 15 ms chop frame period, plotted against one of the objective metrics. The curve is quite consistent across the different model comparisons, meaning a simple quadratic regression fitting from the chop model score to a Mean Opinion Score (MOS) prediction may be sufficient for a good mapping. The example results of the chopped speech detection model for the 10 ms and 15 ms chop periods follow linear trends in FIG. 3 (e.g., example results 340 and 330, respectively, as plotted in FIG. 3), but with different slopes. When these results are plotted against the objective speech quality metrics in FIG. 4 (e.g., plots 400, 410, 420, and 430), it is clear there is an overlap in that the results follow the same curve. This overlap in the results represents a strong relationship between the chop detection model's score and the estimated perceived quality from the objective speech quality metrics.

Figure 5:
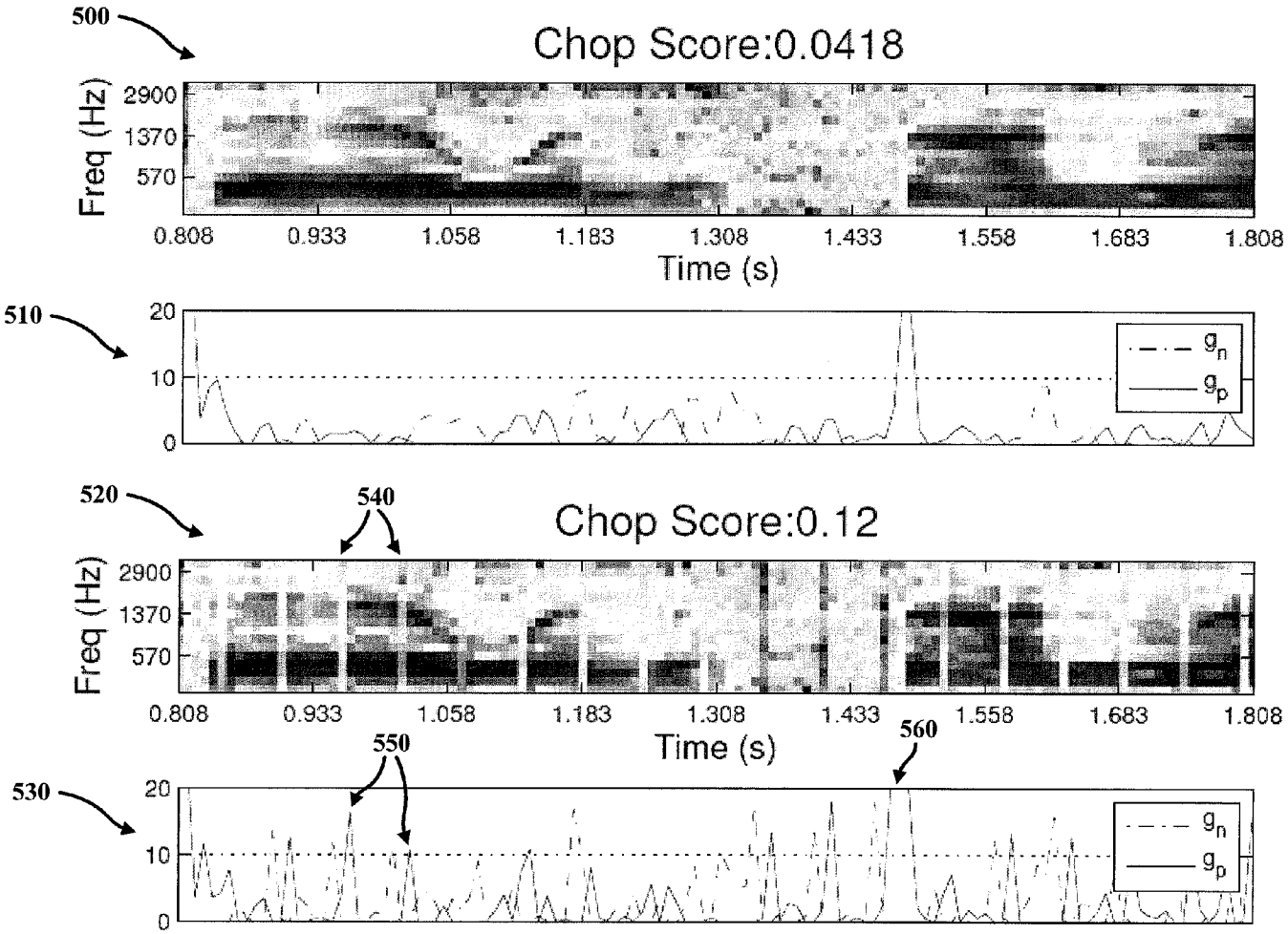
FIG. 5 is a flowchart illustrating an example method for detecting chop in an audio signal according to one or more embodiments described herein.

FIG. 5 illustrates an example of a speech signal with and without chop included. The top two panes show a spectrogram 500 of the clean speech signal and a plot 510 of the corresponding positive and negative gradients, $g_p$ and $g_n$, respectively. The bottom two panes show a spectrogram 520 and plot 530 of the gradients, $g_p$ and $g_n$, for the same speech signal, but with chop added.

Referring to the bottom two panes in FIG. 5, the periodic chop is clearly visible as vertical bands 540 across the spectrogram 520 and in the peaks 550 of the positive ($g_p$) and negative ($g_n$) gradients plotted in 530, which may be used by the model to estimate the signal chop level. In addition to detecting chop, the natural gradients of speech are captured by the model. The natural gradient at 1.5 seconds (identified approximately as point 560) is very apparent in the bottom plot 530. Such speech features are responsible for the low threshold boundary of the chop detection model. The trend for both the 10 ms chop frame period and the 15 ms chop frame period show chopping is successfully detected above the threshold rate of 2 Hz.

Because chop at low rates is common in practice, example tests (not presented here) were also carried out with longer duration speech samples. These example tests demonstrated that improved separation between results for chop and naturally occurring gradient changes can also be achieved through the method of chop detection described herein.

The real chop example tested showed that chop is detected even if the chop value is not zero and the chop frame is shorter than 10 ms, as was the case in the simulated chop tests described above.

The chop measurement model for speech quality provided herein compares favorably to other objective speech quality models/metrics (e.g., ViSQOL, PESQ, POLQA, and P.563). The degradation type detected is a common problem for VoIP and the algorithm described in one or more embodiments is relatively low in computational complexity. This low-complexity factor, combined with the algorithm's applicability to narrowband, wideband, and superwideband speech, means the algorithm is useful in applications other than full-speech quality models. For example, the model described herein may be used as a stand-alone VoIP monitoring tool. While one or more other components (e.g., voice activity detection) may be necessary in order to use the model in a real-time system, the implementation of the model with such other components would be straightforward.

Figure 6:
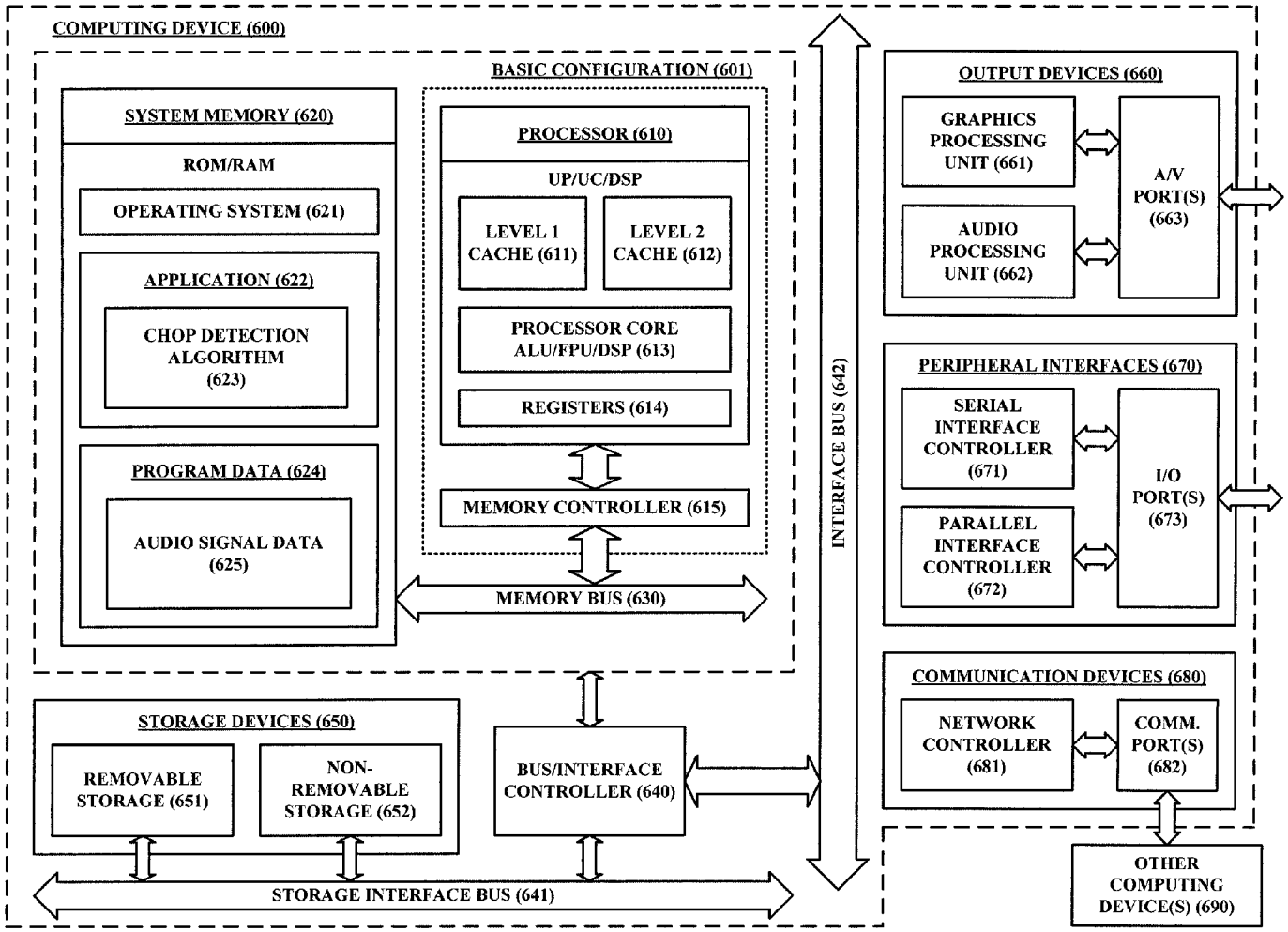
FIG. 6 is a block diagram illustrating an example computing device arranged for detecting chop in an audio signal according to one or more embodiments described herein.

FIG. 6 is a block diagram illustrating an example computing device 600 arranged for implementing a model for detecting chop in an audio signal. In particular, in accordance with one or more embodiments of the present disclosure, the example computing device 600 is arranged for implementing a model for detecting an amount of chopped speech in an audio signal, while remaining insensitive to other types of distortion/degradation. The model is low-complexity and can be applied to narrowband, wideband, and superwideband speech. In a basic configuration 601, computing device 600 typically includes one or more processors 610 and system memory 620. A memory bus 630 may be used for communicating between the processor 610 and the system memory 620.

Depending on the desired configuration, processor 610 can be of any type including but not limited to a microprocessor (μP), a microcontroller (μC), a digital signal processor (DSP), or any combination thereof. Processor 610 may include one or more levels of caching, such as a level one cache 611 and a level two cache 612, a processor core 613, and registers 614. The processor core 613 may include an arithmetic logic unit (ALU), a floating point unit (FPU), a digital signal processing core (DSP Core), or any combination thereof. A memory controller 615 can also be used with the processor 610, or in some embodiments the memory controller 615 can be an internal part of the processor 610.

Depending on the desired configuration, the system memory 620 can be of any type including but not limited to volatile memory (e.g., RAM), non-volatile memory (e.g., ROM, flash memory, etc.) or any combination thereof. System memory 620 typically includes an operating system 621, one or more applications 622, and program data 624. In at least some embodiments, application 622 includes a chop detection algorithm 623 that is configured to detect an amount of chop (e.g., choppy speech) present in an audio signal, while remaining insensitive to other types of distortion/degradation in the signal. The chop detection algorithm 623 is further arranged to use a time-frequency representation (e.g., a short-term Fourier Transform (STFT) spectrogram) of a signal to measure changes in the gradient of mean power per frame of the signal.

Program Data 624 may include audio signal data 625 that is useful for creating the time-frequency representation of the signal and detecting an amount of chop present in the signal. In some embodiments, application 622 can be arranged to operate with program data 624 on an operating system 621 such that detecting the amount of chop in an audio signal includes using a short-term Fourier Transform (STFT) spectrogram of the signal to measure changes in the gradient of the mean frame power.

Computing device 600 can have additional features and/or functionality, and additional interfaces to facilitate communications between the basic configuration 601 and any required devices and interfaces. For example, a bus/interface controller 640 can be used to facilitate communications between the basic configuration 601 and one or more data storage devices 650 via a storage interface bus 641. The data storage devices 650 can be removable storage devices 651, non-removable storage devices 652, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 620, removable storage 651 and non-removable storage 652 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 600. Any such computer storage media can be part of computing device 600.

Computing device 600 can also include an interface bus 642 for facilitating communication from various interface devices (e.g., output interfaces, peripheral interfaces, communication interfaces, etc.) to the basic configuration 601 via the bus/interface controller 640. Example output devices 660 include a graphics processing unit 661 and an audio processing unit 662, either or both of which can be configured to communicate to various external devices such as a display or speakers via one or more A/V ports 663. Example peripheral interfaces 670 include a serial interface controller 671 or a parallel interface controller 672, which can be configured to communicate with external devices such as input devices (e.g., keyboard, mouse, pen, voice input device, touch input device, etc.) or other peripheral devices (e.g., printer, scanner, etc.) via one or more I/O ports 673.

An example communication device 680 includes a network controller 681, which can be arranged to facilitate communications with one or more other computing devices 690 over a network communication (not shown) via one or more communication ports 682. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 600 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 600 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A method for detecting chop in an audio signal, the method comprising:

creating a time-frequency representation for an audio signal;

calculating a gradient of mean power per frame of the audio signal based on the time-frequency representation;

determining an overlap offset between positive values of the gradient and negative values of the gradient;

combining the positive values of the gradient or the negative values of the gradient with the overlap offset; and estimating an amount of chop in the audio signal based on a log of the ratio of the sum of the combined values above a threshold to the sum of the combined values below the threshold.

2. The method of claim 1, further comprising defining positive and negative gradient signals based on the calculated gradient of mean power, wherein the positive gradient signal includes the positive values of the gradient and the negative gradient signal includes the negative values of the gradient.

3. The method of claim 2, wherein determining the overlap offset between the positive values of the gradient and the negative values of the gradient includes calculating a value that maximizes the cross-correlation of the positive gradient signal and the negative gradient signal.

4. The method of claim 1, wherein the time-frequency representation is a short-term Fourier transform (STFT) spectrogram representation created with critical frequency bands between 150 and 3,400 Hz, between 150 and 8,000 Hz, or over 8,000 Hz.

5. The method of claim 1, wherein the time-frequency representation is a short-term Fourier transform (STFT) spectrogram representation created with logarithmically spaced frequency bands between 150 and 3,400 Hz, between 150 and 8,000 Hz, or over 8,000 Hz.

6. The method of claim 1, wherein creating the time-frequency representation for the audio signal includes using a 256-sample, 50% overlap Hanning window for an audio signal with 16 kHz sampling rate and a 128-sample, 50% overlap Hanning window for an audio signal with 8 kHz sampling rate.

7. A system for detecting chop in an audio signal, the system comprising:

one or more processors; and a computer-readable medium coupled to said one or more processors having instructions stored thereon that, when executed by said one or more processors, cause said one or more processors to perform operations comprising:

creating a time-frequency representation for an audio signal;

calculating a gradient of mean power per frame of the audio signal based on the time-frequency representation;

determining an overlap offset between positive values of the gradient and negative values of the gradient;

combining the positive values of the gradient or the negative values of the gradient with the overlap offset; and estimating an amount of chop in the audio signal based on a log of the ratio of the sum of the combined values above a threshold to the sum of the combined values below the threshold.

8. The system of claim 7, wherein the one or more processors are further caused to perform operations comprising defining positive and negative gradient signals based on the calculated gradient of mean power, wherein the positive gradient signal includes the positive values of the gradient and the negative gradient signal includes the negative values of the gradient.

9. The system of claim 8, wherein the one or more processors are further caused to perform operations comprising calculating a value that maximizes the cross-correlation of the positive gradient signal and the negative gradient signal.

10. The system of claim 7, wherein the time-frequency representation is a short-term Fourier transform (STFT) spectrogram representation created with critical frequency bands between 150 and 3,400 Hz, between 150 and 8,000 Hz, or over 8,000 Hz.

11. The system of claim 7, wherein the time-frequency representation is a short-term Fourier transform (STFT) spectrogram representation created with logarithmically spaced frequency bands between 150 and 3,400 Hz, between 150 and 8,000 Hz, or over 8.000 Hz.

12. The system of claim 7, wherein creating the time-frequency representation for the audio signal includes using a 256-sample, 50% overlap Hanning window for an audio signal with 16 kHz sampling rate and a 128-sample, 50% overlap Hanning window for an audio signal with 8 kHz sampling rate.

13. One or more non-transitory computer readable media storing computer-executable instructions that, when executed by one or more processors, cause the one or more processors to perform operations comprising:

creating a time-frequency representation for an audio signal;

calculating a gradient of mean power per frame of the audio signal based on the time-frequency representation;

determining an overlap offset between positive values of the gradient and negative values of the gradient;

combining the positive values of the gradient or the negative values of the gradient with the overlap offset; and estimating an amount of chop in the audio signal based on a log of the ratio of the sum of the combined values above a threshold to the sum of the combined values below the threshold.

14. The one or more non-transitory computer readable media of claim 13, wherein the computer-executable instructions stored thereon, when executed by the one or more processors, further cause the one or more processors to perform operations comprising defining positive and negative gradient signals based on the calculated gradient of mean power, wherein the positive gradient signal includes the positive values of the gradient and the negative gradient signal includes the negative values of the gradient.

15. The one or more non-transitory computer readable media of claim 14, wherein the computer-executable instructions stored thereon, when executed by the one or more processors, further cause the one or more processors to perform operations comprising calculating a value that maximizes the cross-correlation of the positive gradient signal and the negative gradient signal.

16. The one or more non-transitory computer readable media of claim 13, wherein the time-frequency representation is a short-term Fourier transform (STFT) spectrogram representation created with critical frequency bands between 150 and 3,400 Hz, between 150 and 8,000 Hz, or over 8,000 Hz.

17. The one or more non-transitory computer readable media of claim 13, wherein the time-frequency representation is a short-term Fourier transform (STFT) spectrogram representation created with logarithmically spaced frequency bands between 150 and 3,400 Hz, between 150 and 8,000 Hz, or over 8,000 Hz.

* * * * *